US009771253B2

(12) United States Patent
Rudick et al.

(10) Patent No.: US 9,771,253 B2
(45) Date of Patent: Sep. 26, 2017

(54) BEVERAGE DISPENSER WITH COMPONENT WASH SYSTEM

(71) Applicant: The Coca-Cola Company, Atlanta, GA (US)

(72) Inventors: Arthur G. Rudick, Atlanta, GA (US); Gregg Carpenter, Marietta, GA (US); David R. Newman, Atlanta, GA (US); Daniel S. Quartarone, Stone Mountain, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 210 days.

(21) Appl. No.: 14/681,141

(22) Filed: Apr. 8, 2015

(65) Prior Publication Data

US 2015/0298956 A1 Oct. 22, 2015

Related U.S. Application Data

(60) Provisional application No. 61/981,861, filed on Apr. 21, 2014.

(51) Int. Cl.

| | |
|---|---|
| ***B67D 1/07*** | (2006.01) |
| *B67D 1/08* | (2006.01) |
| *B67D 1/00* | (2006.01) |
| *G07F 13/10* | (2006.01) |

(52) U.S. Cl.

CPC ..... *B67D 1/07* (2013.01); *B67D 1/0021* (2013.01); *B67D 1/0041* (2013.01); *B67D 1/0054* (2013.01); *B67D 1/0895* (2013.01); *G07F 13/10* (2013.01)

(58) Field of Classification Search

CPC ... B67D 1/07; B67D 1/00; B67D 1/08; B67D 1/0021; B67D 1/0041; B67D 1/0895; B67D 1/0054; G01F 13/10

USPC ..... 222/148–151, 129.1, 63, 325–327, 222/108–109, 318, 333–334

See application file for complete search history.

(56) References Cited

U.S. PATENT DOCUMENTS

| | | | | |
|---|---|---|---|---|
| 3,858,627 A * | 1/1975 | Hinxlage | A47L 15/247 | 134/105 |
| 4,735,175 A | 4/1988 | Kaunisvesi | | |
| 5,350,082 A * | 9/1994 | Kiriakides, Jr. | G07F 13/10 | 221/1 |
| 5,744,184 A | 4/1998 | Kendall et al. | | |
| 5,749,179 A * | 5/1998 | Bohacik | B05B 15/00 | 239/283 |
| 5,855,295 A * | 1/1999 | Lee | G07F 13/00 | 134/34 |

(Continued)

OTHER PUBLICATIONS

U.S. Appl. No. 61/981,861, filed Apr. 21, 2014, Rudick, et al.

(Continued)

*Primary Examiner* — Patrick M Buechner
*Assistant Examiner* — Andrew P Bainbridge
(74) *Attorney, Agent, or Firm* — Eversheds Sutherland (US) LLP

(57) ABSTRACT

The present application provides a beverage dispensing system using a sweetener. The beverage dispensing system may include a sweetener source with the sweetener therein, one or more rotating or stationary components positioned about a flow of the sweetener, and a component wash system positioned about the one or more rotating or stationary components to wash off the sweetener thereon.

17 Claims, 5 Drawing Sheets

(56) References Cited

U.S. PATENT DOCUMENTS

| | | | | |
|---|---|---|---|---|
| 6,196,422 | B1 * | 3/2001 | Tuyls | B67D 1/0024 222/129.1 |
| 6,401,729 | B1 | 6/2002 | Ford | |
| 7,544,253 | B2 * | 6/2009 | Kleiger | B08B 9/0321 134/10 |
| 7,735,687 | B2 | 6/2010 | Fukushima et al. | |
| 7,757,896 | B2 * | 7/2010 | Carpenter | B67D 1/0051 222/129.1 |
| 7,794,547 | B2 * | 9/2010 | Mann | B08B 3/02 122/379 |
| 7,993,468 | B2 | 8/2011 | Staten | |
| 8,079,230 | B2 | 12/2011 | Frank et al. | |
| 8,181,825 | B2 | 5/2012 | Reddy et al. | |
| 8,322,570 | B2 * | 12/2012 | Beavis | A47J 31/36 222/129.1 |
| 8,371,477 | B2 * | 2/2013 | Klopfenstein | B67D 1/0031 222/129.4 |
| 2002/0083549 | A1 * | 7/2002 | Deiterman | A47L 11/30 15/320 |
| 2002/0127140 | A1 * | 9/2002 | Berge | A61L 2/18 422/28 |
| 2003/0024598 | A1 * | 2/2003 | Colombo | B67D 1/07 141/91 |
| 2004/0118291 | A1 | 6/2004 | Carhuff et al. | |
| 2006/0169717 | A1 * | 8/2006 | Fukushima | B08B 3/00 222/129.1 |
| 2006/0175352 | A1 | 8/2006 | Emmendorfer et al. | |
| 2006/0273120 | A1 | 12/2006 | Staten | |
| 2009/0014464 | A1 | 1/2009 | Adbelmoteleb et al. | |
| 2010/0140296 | A1 * | 6/2010 | Sasaki | B67D 1/07 62/340 |
| 2010/0318225 | A1 | 12/2010 | Claesson et al. | |
| 2013/0248560 | A1 | 9/2013 | Carpenter et al. | |
| 2014/0040055 | A1 | 2/2014 | Quartarone et al. | |

OTHER PUBLICATIONS

Dan Quartarone, et al.; Title: System for Washing Critical Surfaces of an Automated Dispenser with Recycled Water, Record of Invention, Dated Feb. 2, 2012, Revised May 23, 2012, pp. 1-6.

* cited by examiner

BEVERAGE DISPENSER WITH COMPONENT WASH SYSTEM

RELATED APPLICATIONS

The present application claims priority to U.S. Provisional Patent Application Ser. No. 61/981,861, filed on Apr. 21, 2014. U.S. Provisional Patent Application Ser. No. 61/981,861 is incorporated herein by reference.

TECHNICAL FIELD

The present application and the resultant patent relate generally to systems and methods for dispensing products and more particularly relate to systems and methods for dispensing products such as beverages and the like with an automated wash system for select components therein to remove or prevent a buildup of dried sweeteners.

BACKGROUND OF THE INVENTION

Beverage dispensers traditionally combine a diluent such as water with a beverage base such as syrup and the like. These beverage bases generally have a dilution or reconstitution ratio of about three to one to about six to one. The beverage bases usually come in large bag-in-box containers that require significant amounts of storage space and may need refrigeration. These storage requirements generally result in positioning the bag-in-box containers away from the dispenser in a back room and the like with a number of pumps and long supply lines. Each bag-in-box container usually holds a beverage base for a single type or flavor of beverage such that multiple bag-in-box containers may be required to provide the consumer with a beverage dispenser having a variety of beverage options.

Recent improvements in beverage dispensing technology have focused on the use of micro-ingredients. With micro-ingredients, the traditional beverage bases may be separated into their constituent parts at much higher reconstitution ratios. These micro-ingredients may be stored in much smaller packages and stored closer to, adjacent to, or within the beverage dispenser itself. The beverage dispenser preferably may provide the consumer with multiple beverage options as well as the ability to customize a beverage as desired. This micro-ingredient technology has been incorporated in the popular "Freestyle®" refrigerated beverage dispensing units provided by The Coca-Cola Company of Atlanta, Ga. The "Freestyle®" refrigerated beverage dispensing units can dispense over 125 flavors or brands without the need for expensive storage space. These micro-ingredients then may be mixed with macro-ingredients such as conventional high fructose corn syrup (HFCS) or sugar sweeteners.

One issue with the use of either conventional bag-in-box syrups or the use of sweeteners and micro-ingredients concerns the buildup of sweetener on critical surfaces. Specifically, dried sweetener may gum up the components of known dispensers. If the dried sweetener is not regularly removed from such critical surfaces, the dried sweetener may cause enough friction between the mechanical components to cause them to seize. Further, the dried sweetener may present enough interference to degrade the performance of an electronic sensor. As a result, known dispensers generally require time and labor intensive washing procedures to remove the dried sweetener. Moreover, such current washing procedures may require large amounts of water that otherwise serve no useful purpose.

There is thus a desire for an improved dispensing system and the like that can accommodate or prevent the buildup of sweetener on critical surfaces. Moreover, such a dispensing system may periodically clean such surfaces with an efficient and limited use of water.

SUMMARY OF THE INVENTION

The present application and the resultant patent thus provide a beverage dispensing system using a sweetener. The beverage dispensing system may include a sweetener source with the sweetener therein, one or more rotating or stationary components positioned about a flow of sweetener, and a component wash system positioned about the one or more rotating or stationary components to wash off the sweetener thereon.

The present application and the resultant patent further may provide a method of operating a beverage dispensing system with a flow of a sweetener therein. The method may include the steps of positioning one or more rotating or stationary components about the flow of the sweetener, positioning a component wash system about the one or more rotating or stationary components, routing a flow of ice bin melt water to the component wash system, and providing a flow of the ice bin melt water to the one or more rotating or stationary components.

The present application and the resultant patent further may provide a beverage dispensing system using a flow of a sweetener. The beverage dispensing system may include a sweetener source with the sweetener therein, one or more rotating or stationary components positioned about the flow of the sweetener, an ice bin with a flow of melt water, and a component wash system positioned about the one or more rotating or stationary components so as to wash off the sweetener with the flow of melt water.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
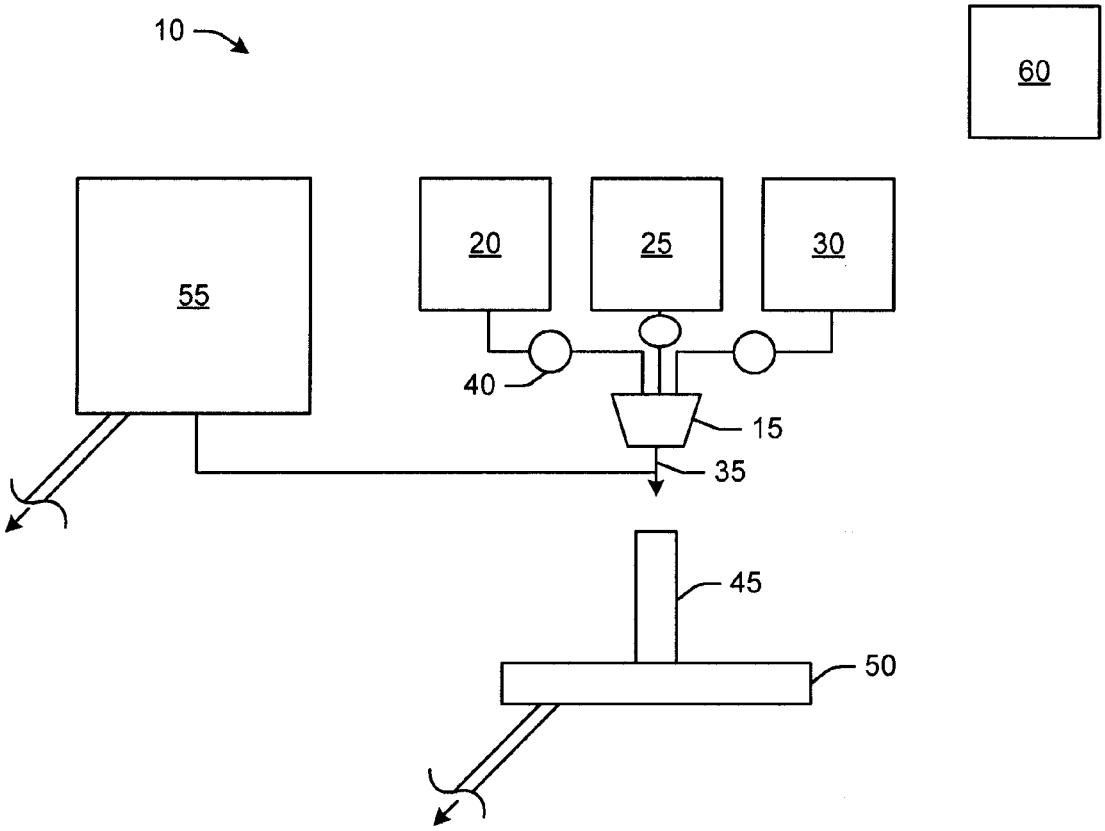
FIG. 1 is a schematic diagram of a beverage dispensing system.

Referring now to the drawings, in which like numerals refer to like elements throughout the several views, FIG. 1 shows an example of a beverage dispensing system 10. The beverage dispensing system 10 may be similar to that described in commonly owned U.S. Pat. No. 7,757,896 entitled "BEVERAGE DISPENSING SYSTEM," incorporated herein in full. Generally described, the beverage dispensing system 10 may include a dispensing nozzle 15. The dispensing nozzle 15 may combine a number of micro-ingredients 20, one or more macro-ingredients 25, a diluent 30, and/or other ingredients to create a beverage 35. Alternatively, the dispensing nozzle 15 may combine a syrup and the diluent 30 to create the beverage 35. The respective ingredients may be pumped to the dispensing nozzle 15 by a conventional pump 40 or other types of fluid moving devices. The beverage ingredients may mix in or downstream of the dispensing nozzle 15 and fall into a consumer's cup 45 or other type of vessel. The cup 45 generally may be positioned about a drip tray 50 or other type of support. An ice bin 55 may be positioned within or adjacent to the beverage dispensing system 10. The ice bin 55 may be configured to dispense a predetermined amount of ice into the consumer's cup 45 or elsewhere.

The micro-ingredients 20 generally have reconstitution ratios of about 10:1 and higher, 20:1 and higher, 50:1 and higher, and/or 100:1 and higher. Examples of the micro-ingredients 20 include natural and artificial flavors, flavor additives, natural and artificial colors, artificial sweeteners, non-nutritive sweeteners, additives for controlling tartness, functional additives, and the like. Other types of micro-ingredients 20 may be used herein. The macro-ingredients 25 generally have reconstitution ratios in the range of about 3:1 to about 6:1. The macro-ingredients 25 may include sugar, syrup, HFCS, fruit concentrates, and the like. Other types of macro-ingredients 25 may be used herein. The diluent 30 may be water, carbonated water, and other types of fluids. Other types and combinations of ingredients also may be used herein.

Dispensing the beverage 35 from the dispensing nozzle 15 may be controlled by a control device 60. The control device 60 may be a conventional micro-computer and the like capable of executing programmable commands. The control device 60 may be internal or external from the beverage dispensing system 10. The functionality of the control device 60 may be implemented in software, firmware, hardware, or any combination thereof. One control device 60 may control multiple beverage dispensing systems 10 and/or one beverage dispensing system 10 may have multiple control devices 60 with specific tasks. The beverage dispensing system 10 described herein is for the purpose of example only. Many other types and configurations of the beverage dispensing systems, and the components thereof, may be used.

Figure 2:
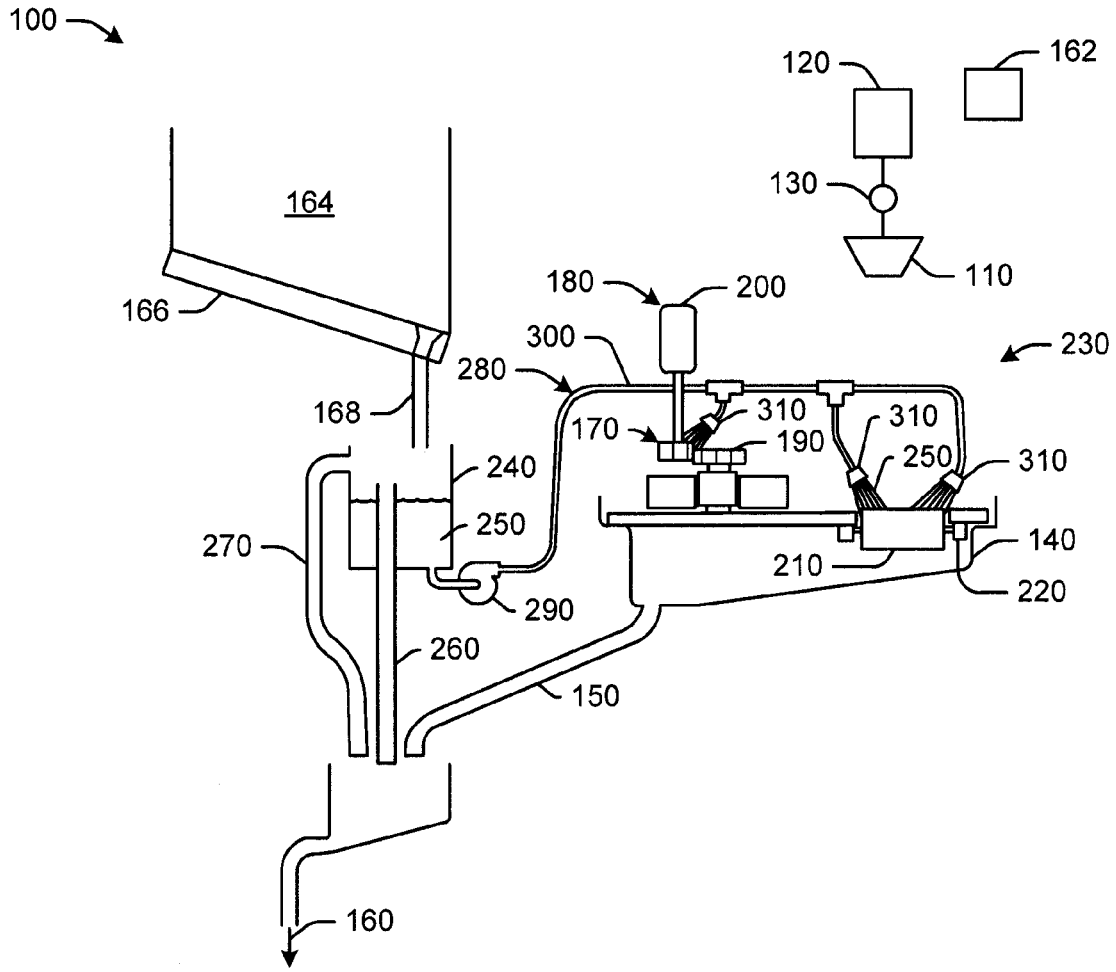
FIG. 2 is a schematic diagram of a portion of a beverage dispensing system with a component wash system as may be described herein.

FIG. 2 shows a portion of a beverage dispensing system 100 as may be described herein. In a manner similar to that described above, the beverage dispensing system 100 may include a dispensing nozzle 110. The dispensing nozzle 110 may have any suitable size, shape, or configuration. The dispensing nozzle 110 may be in communication with a number of ingredients including a nutritive sweetener source 120. The nutritive sweetener source 120 may include a volume of a nutritive sweetener 125 therein. The nutritive sweetener 125 may include HFCS, sugar-based sweeteners, and the like. The nutritive sweetener source 120 may be a stand-alone source for use with a number of the micro-ingredients or in the form of a syrup in a conventional bag-in-box configuration and the like. Any type of nutritive sweetener source 120 may be used herein with any type or volume of nutritive sweetener 125. The nutritive sweetener source 120 may be in communication with the dispensing nozzle 110 via a pump 130 or other type of fluid moving device. A drip tray 140 may be positioned adjacent to the dispensing nozzle 110 or elsewhere. The drip tray 140 may have any suitable size, shape, or configuration. The drip tray 140 may include a drip tray drain tube 150. The drip tray drain tube 150 may be in communication with a conventional drain 160. Overall operation of the beverage dispensing system 110 may be controlled by a control device 162. The control device 162 may be similar to that described above. Other components and other configurations may be used herein.

The beverage dispensing system 100 also may include an ice bin 164 with any volume of ice therein. The ice bin 164 may have any suitable size, shape, or configuration. The ice bin 164 may be bounded on a bottom surface or elsewhere by a cold plate 166. The cold plate 166 also may chill other types of fluid flowing through the beverage dispensing system 100. Other types of chilling devices may be used herein to create and maintain the ice in the ice bin 164. The ice bin 164 may have an ice bin drain tube 168 extending therefrom. The ice bin drain tube 168 may be in communication with the drain 160 or elsewhere. The drip tray drain tube 150 and the ice bin drain tube 168 may be physically separated leading to the drain 160. Other components and other configurations also may be used herein.

The beverage dispensing system 100 may include a number of rotating components 170. The rotating components 170 may be part of a conventional mechanical or electro-mechanical device 180 and the like. As is shown in, for example, FIG. 2, the rotating components 170 may be a set of gears 190 and the like. The gears 190 may have any suitable size, shape, or configuration. The gears 190 may be driven by an electrical motor 200 or other type of drive mechanism. Likewise, the rotating components 170 may include a bearing block 210 supporting a rotating shaft 220. The rotating shaft 220 also may transmit force to other types of components. The rotating shaft 220 may have any suitable size, shape, or configuration. The rotating components 170 may be any type of force transmitting device and related components (moving or not). Other components and other configurations may be used herein.

The beverage dispensing system 100 also may include a component wash system 230. The component wash system 230 may include a wash reservoir 240. The wash reservoir 240 may have any suitable size, shape, or configuration. The wash reservoir 240 may be in communication with the ice bin drain tube 168. The wash reservoir 240 thus may be fed with a volume of melt water 250 from the ice bin 164 or elsewhere. Other sources of water or other fluids also may be used herein. Specifically, the municipal water supply may be used. The melt water 250 otherwise would be directed to the drain 160 without any useful purpose. The wash reservoir 240 may have a wash reservoir drain tube 260 in communication with the drain 160. The wash reservoir 240 also may have an emergency overflow drain tube 270 in communication with the drain 160. The drain tubes 260, 270 may have any suitable size, shape, or configuration. Other components and other configurations may be used herein.

The component wash system 230 also may have a water distribution system 280 in communication with the wash reservoir 240. The water distribution system 280 may include one or more pumps 290 or other type of fluid moving device. The pumps 290 may have any suitable size or capacity. The water distribution system 280 may include one or more wash lines 300 in communication with the wash reservoir 240 and the pumps 290. The water distribution system 280 further may include a number of spray nozzles 310 positioned on the wash lines 300. The wash lines 300 and the spray nozzles 310 may have any suitable size, shape, or configuration. The spray nozzles 310 may be positioned adjacent to the rotating components 170 or other surfaces so as to supply a spray of melt water 250 thereon to remove or prevent a build-up of dried sweetener. Other components and other configurations may be used herein.

Figure 3:
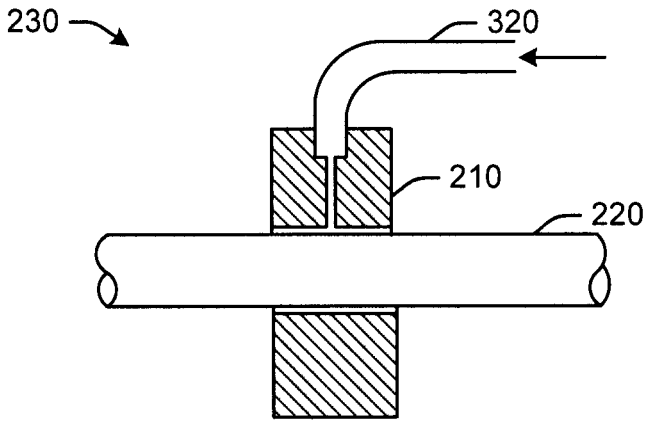
FIG. 3 is a partial sectional view of the component wash system of FIG. 2.

As is shown in FIG. 3, the water distribution system 280 also may include a drip tube 320 in communication with the wash lines 300 or otherwise. The drip tube 320 may have any suitable size, shape, or configuration. The drip tube 320 may be positioned adjacent to one or more of the rotating components 170 so as to provide a drip or other type of low volume flow of the melt water 250 thereon. In the example of FIG. 3, the drip tube 320 may provide a drip of the melt water 250 to the rotating shaft 220 so as to remove or prevent a build-up of dried sweetener thereon. The spray nozzles 310 and the drip tubes 320 may be used separately and/or together depending upon the nature of the components and other parameters. Other components and other configurations may be used herein.

Figure 4:
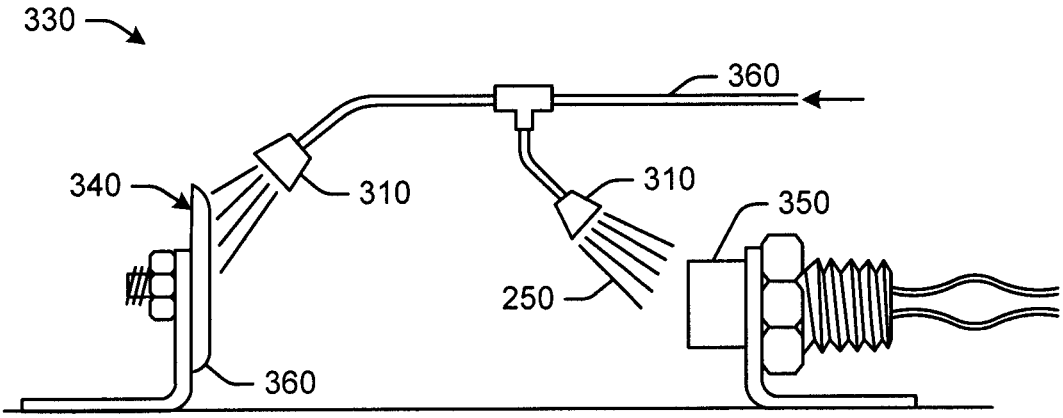
FIG. 4 is a partial elevation view of the component wash system of FIG. 2.

As is shown in FIG. 4, the beverage dispensing system 100 also may include a number of stationary components 330. In this example, an electric sensor 340 is shown. The electric sensor 340 may include a transceiver 350 and a reflector 360. One or more of the spray nozzles 310 and/or the drip tubes 320 may be positioned thereabout so as to provide a spray or a drip of the melt water 250 to remove or prevent a build-up of dried nutritive sweetener thereon. Other types of stationary components 330 and other types of electrical sensors 340 also may be used herein. Other components and other configuration may be used herein.

Figure 5:
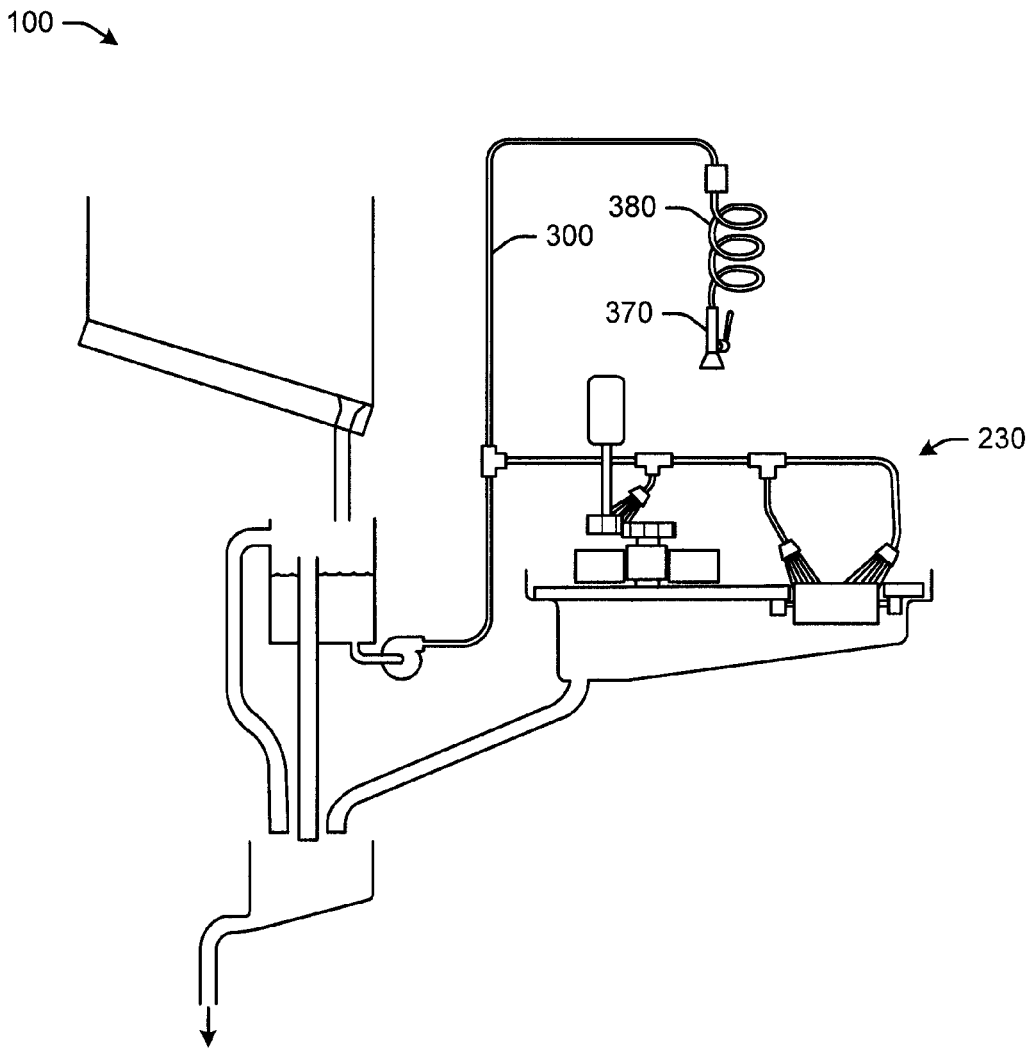
FIG. 5 is a schematic diagram of a beverage dispensing system with an alternative embodiment of a component wash system with a hand operated sprayer as may be described herein.

FIG. 5 shows a further embodiment of the component wash system 230. In this example, the component wash system 230 may include a hand operated spray nozzle 370. The hand operated spray nozzle 370 may have any suitable size, shape, or configuration. The hand operated spray nozzle 370 may be positioned about a flexible hose 380. The use of the hand operated spray nozzle 370 allows for a spray of the melt water 250 to be manually directed to any surface of the beverage dispensing system 100 for cleaning. The hand operated spray nozzle 370 may be used on its own or with other wash components as may be desired. Other components and other configurations may be used herein.

Figure 6:
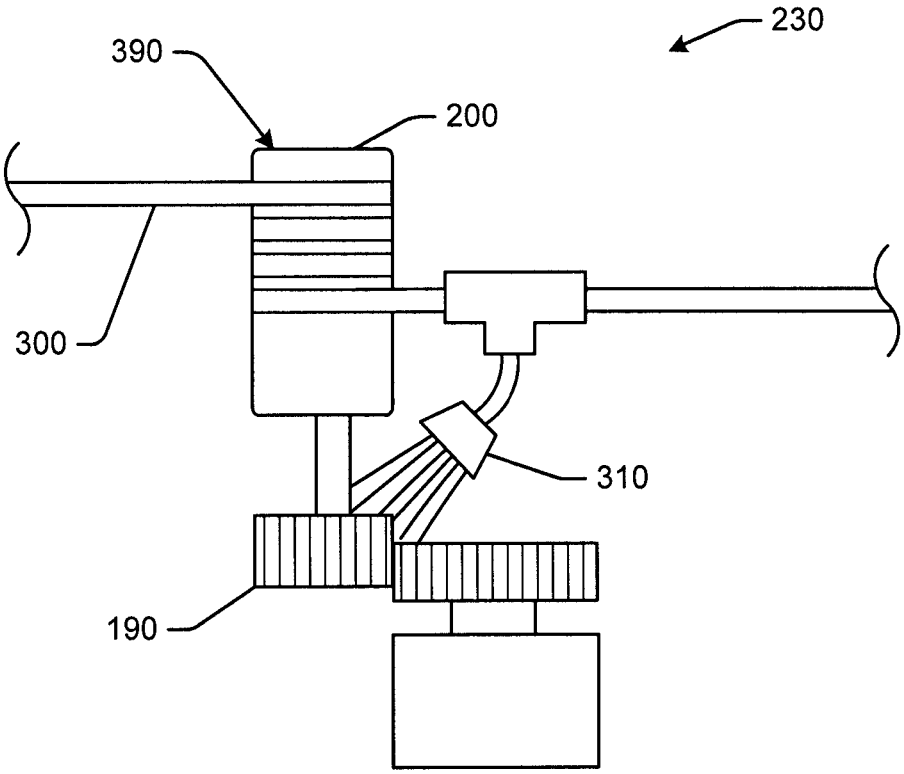
FIG. 6 is a schematic diagram of a beverage dispensing system with a further alternative embodiment of a component wash system with a source of waste heat as may be described herein.

FIG. 6 shows a further embodiment of the component wash system 230. In this embodiment, one or more of the wash lines 300 may be positioned about a source of waste heat 390. The waste heat 390 may be used to heat the flow of the melt water 250. In this example, the source of the waste heat 390 may be the electrical motor 200 used to drive the gears 190. Any other source of waste heat or other heat source may be used herein to heat the melt water 250. For example, heat from the evaporator coils of the ice maker and the like may be used. Further, an in-line heater may be used before or after the pump 290 and/or in the reservoir 240. Moreover, the reservoir 240 may be manually accessed such that hot water may be poured therein for periodic cleaning. Other components and other configurations may be used herein.

In use, the beverage dispensing system 100 uses the component wash system 230 to direct periodically a flow of the melt water 250 or other type of water or other fluid to the components that may be impacted by a buildup of the sweetener. The component wash system 230 uses the melt water 250 that would otherwise be sent directly to the drain 160 without providing any further useful work. A wash cycle may be initiated by the controller 162 at regular and/or timed intervals. The wash cycle also may be initiated in response to a change in the electrical input required to drive a motor. Such a change in electrical input may indicate that dried sweetener is beginning to increase friction within the system. Moreover, a wash cycle may be initiated in response to a degraded performance of an electronic sensor. Such a degraded performance may indicate that the sensor is being coated with the dried sweetener. A wash cycle also may be initiated by a manual input to the controller 162. Other operational parameters may be used herein.

After washing the component surface, the drain water 250 may be caught by the drip tray 140 and directed to the drain 160 or disposed of in any other fashion. The melt water 250 may be applied via the spray nozzles 310, the drip tube 320, the hand operated spray nozzle 370, or otherwise. Any component surface or mechanical interface may be cleaned herein. The melt water 250 effectively dilutes and disperses the accumulated dried sweetener. The manual operated spray nozzle 320 also may be used for cleaning a surface that may not be adequately covered by the fixed spray nozzle 310, the drip tubes 320, or otherwise. Other types of water delivery devices may be used herein.

Although the melt water 250 from the ice bin 164 is used herein, any source of water may be used including the municipal water supply and the like. In any case, the volume of water required to clean the beverage dispensing system 100 may be greatly reduced as compared to currently methods. Warm water also may be used herein. The warm water may be effective in removing the sweetener. The melt water 250 or other water source thus may be heated by the waste heat source 390 or otherwise.

The use of automatic washings thus may prevent or limit operational failures such that overall dispenser maintenance and maintenance costs may be reduced. For example, the component wash system 230 may be well suited for automated beverage dispensers such as those shown in commonly owned U.S. Patent Publication No. 2013/1226338 to Pickett et al. entitled "Automated Beverage Dispensing System with Cup Lidding and Beverage Identification" and/or U.S. Patent Publication No. 2013/0220480 to Angus et al. entitled "Automated Beverage Dispensing System with Ice and Beverage Dispensing." U.S. Patent Publication No. 2013/1226338 and U.S. Patent Publication No. 2013/0220480 are incorporated herein by reference in full. Such a wash system provides a level of automatic maintenance so as to reduce maintenance calls and maintenance work.

Likewise, the amount of water required to clean the dispenser may be reduced in an ecologically friendly fashion. The washing procedures may be done quickly without disrupting overall dispenser operation. Current washing procedures are in fact disruptive to operation, labor intensive, and time consuming. An overall efficient beverage dispensing system is thus provided herein that avoids such issues without an increase in costs.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A beverage dispensing system using a sweetener, comprising:

a sweetener source with the sweetener therein;

one or more rotating or stationary components positioned along a flow of the sweetener;

a component wash system positioned adjacent to the one or more rotating or stationary components to wash off the sweetener thereon; and a source of waste heat in communication with the component wash system, wherein the source of waste heat comprises waste heat from a motor, an evaporator coil, or a combination thereof associated with the beverage dispensing system.

2. The beverage dispensing system of claim 1, further comprising an ice bin with a volume of melt water.

3. The beverage dispensing system of claim 2, wherein the component wash system comprises a wash reservoir in communication with the melt water from the ice bin.

4. The beverage dispensing system of claim 3, wherein the wash reservoir comprises a wash reservoir drain tube.

5. The beverage dispensing system of claim 1, wherein the component wash system comprises a wash reservoir in communication with a source of water.

6. The beverage dispensing system of claim 1, wherein the component wash system comprises one or more spray nozzles.

7. The beverage dispensing system of claim 6, wherein the one or more spray nozzles comprise a hand operated spray nozzle.

8. The beverage dispensing system of claim 1, wherein the component wash system comprises one or more drip tubes.

9. The beverage dispensing system of claim 1, wherein the motor comprises an electric motor.

10. The beverage dispensing system of claim 1, further comprising a drip tray and wherein the component wash system is positioned adjacent to the drip tray.

11. The beverage dispensing system of claim 1, wherein the one or more rotating or stationary components comprise a set of gears.

12. The beverage dispensing system of claim 1, wherein the one or more rotating or stationary components comprise a rotating shaft and/or a bearing block.

13. The beverage dispensing system of claim 1, wherein the one or more rotating or stationary components comprise a sensor.

14. A method of operating a beverage dispensing system with a flow of a sweetener therein, comprising:

positioning one or more rotating or stationary components along the flow of the sweetener;

positioning a component wash system adjacent to the one or more rotating or stationary components;

routing a flow of ice bin melt water to the component wash system;

heating the flow of ice bin melt with a source of waste heat in communication with the component wash system, wherein the source of waste heat comprises waste heat from a motor, an evaporator coil, or a combination thereof associated with the beverage dispensing system; and providing the flow of the ice bin melt water to the one or more rotating or stationary components.

15. A beverage dispensing system using a sweetener therein, comprising:

a sweetener source with the sweetener therein;

one or more rotating or stationary components positioned along a flow of the sweetener, wherein the one or more rotating or stationary components comprise a bearing block supporting a rotating shaft;

an ice bin with a flow of melt water;

a component wash system positioned adjacent to the one or more rotating or stationary components to wash off the sweetener with the flow of melt water, wherein the component wash system comprises a wash reservoir in communication with the flow melt water from the ice bin, wherein the component wash system comprises one or more drip tubes in communication with the bearing block to provide a drip of the melt water to the rotating shaft; and a source of waste heat in communication with the component wash system, wherein the source of waste heat comprises waste heat from a motor, an evaporator coil, or a combination thereof associated with the beverage dispensing system.

16. The beverage dispensing system of claim 15, wherein the component wash system comprises one or more spray nozzles.

17. The beverage dispensing system of claim 15, wherein the one or more rotating or stationary components comprise a set of gears, a rotating shaft, and/or a sensor.

* * * * *